US009708121B2

(12) United States Patent
Yang

(10) Patent No.: US 9,708,121 B2
(45) Date of Patent: Jul. 18, 2017

(54) WASTE COMPRESSION DEVICE WITH FEE CALCULATION FUNCTION

(76) Inventor: Chen Yang, Taoyuan County (TW)

( * ) Notice: Subject to any disclaimer, the term of this patent is extended or adjusted under 35 U.S.C. 154(b) by 437 days.

(21) Appl. No.: 13/553,817

(22) Filed: Jul. 20, 2012

(65) Prior Publication Data

US 2014/0025589 A1 Jan. 23, 2014

(51) Int. Cl.
*B65F 1/14* (2006.01)

(52) U.S. Cl.
CPC ..... *B65F 1/1426* (2013.01); *B65F 1/1405* (2013.01); *B65F 2210/116* (2013.01); *B65F 2210/124* (2013.01); *B65F 2210/132* (2013.01); *B65F 2210/1443* (2013.01); *B65F 2210/1525* (2013.01); *B65F 2210/164* (2013.01); *B65F 2210/168* (2013.01); *B65F 2210/176* (2013.01); *B65F 2240/108* (2013.01); *B65F 2240/1126* (2013.01); *B65F 2240/12* (2013.01)

(58) Field of Classification Search
USPC ..... 705/308
See application file for complete search history.

(56) References Cited

U.S. PATENT DOCUMENTS 4,653,627 A * 3/1987 Hampson et al. ..... 194/209
4,732,331 A * 3/1988 Hughes ..... 241/1
4,953,682 A * 9/1990 Helbawi ..... 194/208
5,042,634 A * 8/1991 Gulmini ..... 194/209
5,887,696 A * 3/1999 Goetz ..... 194/208
7,180,026 B1 * 2/2007 Guntveit et al. ..... 209/583
2002/0108507 A1 * 8/2002 May et al. ..... 100/45
2009/0145309 A1 * 6/2009 Fox ..... 100/35
2010/0071572 A1 * 3/2010 Carroll et al. ..... 100/229 A
2012/0301254 A1 * 11/2012 Stovring ..... 414/305
2013/0228623 A1 * 9/2013 Virella ..... 235/454

* cited by examiner

*Primary Examiner* — Jan P Mincarelli
(74) *Attorney, Agent, or Firm* — Muncy, Geissler, Olds & Lowe, P.C.

(57) ABSTRACT

A waste compression device with a fee calculation function is provided for shaking and compressing wastes and calculating the quantity of the wastes. The waste compression device includes a casing. The casing has therein: a storage cart; a compression unit for compressing the wastes in the storage cart; a vibration unit for shaking the storage cart; a quantity sensor; a storage level sensor; an interface unit; and a control unit. The control unit controls the compression and vibration. The interface unit determines the best time to shake and compress the wastes according to the wastes level, and instructs a ticketing unit to dispense a coupon for joining a points reward scheme or receiving a cash discount or a gift according to the wastes quantity. The waste compression device calculates the quantity of the wastes, reduces the volume of the wastes, and encourages consumers to take the initiative in recycling wastes.

8 Claims, 6 Drawing Sheets

WASTE COMPRESSION DEVICE WITH FEE CALCULATION FUNCTION

BACKGROUND OF THE INVENTION

1. Field of the Invention

The present invention relates to waste compression devices with a fee calculation function, and more particularly, to a processing device for shaking and compressing wastes and calculating the quantity of the wastes, and includes a casing having therein a storage cart for holding the waste, a vibration unit, and a compression unit, and more particularly, to a waste compression device with a fee calculation function, wherein the waste compression device comprises a casing having therein a control unit and a sensor of a compression unit for controlling the vibration unit, as well as an interface unit and a ticketing unit which are controlled by the control unit.

2. Description of Related Art

Recyclable wastes include aluminum foil bags, iron cans, aluminum cans, and plastic bottles. A conventional method for recycling the waste involves sorting collected wastes into paper, metal, and plastics, and then compressing various wastes with a compressor to reduce the volume of the wastes and thereby facilitate the storage and delivery thereof.

However, plenty of the wastes are liquid containers, such as bottles and cans; hence, residual liquid inside the containers is likely to leak into the surroundings. In particular, upon compression of the wastes, the residual liquid escapes from the containers to thereby end up in the surroundings completely and accumulate in the form of waste liquid. When exposed to air and sunshine for a long period of time, the waste liquid is likely to rot, ferment, and breed germs, mosquitoes, and flies to the detriment of environmental hygiene.

To solve the above problems, a commercially available waste compressing and freezing locker with storing, freezing, and compressing functions is put forth according to the prior art. Bags of wastes are cast into the waste compressing and freezing locker and compressed therein. Inside the waste compressing and freezing locker, the wastes and waste liquid therein are frozen and prevented from causing environmental pollution.

To encourage consumers to take the initiative in recycling wastes, some warehouse stores and convenience stores offer customers various coupons in exchange for recyclable wastes. The coupons are required for joining a points reward scheme or receiving a cash discount or a gift. However, the waste compressing and freezing locker determines the quantity of wastes therein by weighing the wastes. If the quantity of the wastes is assessed by the quantity of bottles and cans, the assessment result will be inaccurate.

Furthermore, the prior art teaches counting the bottles and cans of wastes with a commercially available barcode scanning device. However, it is incapable of compressing and freezing wastes, not to mention that the barcode on the bottles and cans is susceptible to damage and is likely to be smeared, thereby compromising the accuracy of barcode scanning. Accordingly, it is imperative to overcome the aforesaid drawbacks of the prior art.

SUMMARY OF THE INVENTION

It is an objective of the present invention to enhance the ease of operation in terms of compressing wastes and calculating the quantity of the wastes, by overcoming the drawbacks of the prior art—the quantity of the wastes is assessed by weighing the wastes and performing barcode scanning, thereby compromising the accuracy of calculating the quantity of the wastes.

In order to achieve the above and other objectives, the present invention provides a waste compression device with a fee calculation function, comprising a casing, the casing having a waste inlet and having therein:

a control unit;

a compression unit positioned proximate to a top of the casing and electrically connected to the control unit;

a storage cart disposed beneath and corresponding in position to the compression unit, the storage cart being in communication with the inlet, such that wastes fall into the storage cart;

a vibration unit disposed at a bottom of the storage cart, electrically connected to the control unit, and adapted to shake the storage cart, such that the wastes in the storage cart level off;

a quantity sensor disposed in the inlet, electrically connected to the control unit, and adapted to calculate a quantity of the wastes and send a quantity signal to the control unit;

a storage level sensor disposed at a proximal side of the storage cart, electrically connected to the control unit, and adapted to determine whether a level of the wastes in the storage cart reaches a preset height, such that the control unit instructs the vibration unit to shake the storage cart as soon as the storage level sensor determines that the level of the wastes reaches the preset height for the first time and instructs the compression unit to press the wastes in the storage cart as soon as the storage level sensor determines that the level of the wastes reaches the preset height for the second time;

an interface unit exposed from the casing, electrically connected to the control unit, adapted to receive the quantity signal and display the quantity of the wastes, and adapted to send an acknowledgment signal to the control unit, so as to cause the control unit to generate a ticketing signal; and a ticketing unit exposed from the casing, electrically connected to the control unit, and adapted to receive the ticketing signal and dispense a coupon.

A user can cast recyclable wastes packaged in bottles, cans, or aluminum foil bags into the storage cart via an inlet thereof. Under the control of the control unit, at the point in time when a waste is passing through the inlet, the quantity sensor calculates the waste quantity precisely, and the interface unit displays the quantity of the wastes which have been cast into the storage cart. Also, with the interface unit, the user can control the ticketing unit to dispense a coupon required for joining a points reward scheme or receiving a cash discount or a gift. The control unit instructs the vibration unit to shake the storage cart as soon as the storage level sensor determines that the level of the wastes reaches the preset height for the first time and instructs the compression unit to press the wastes in the storage cart as soon as the storage level sensor determines that the level of the wastes reaches the preset height for the second time. The waste compression device calculates the quantity of the wastes, reduces the volume of the wastes, and encourages consumers to take the initiative in recycling wastes.

To enable the wastes in the storage cart to be preserved at a low temperature, the waste compression device of the present invention further comprises a freezing unit disposed on the inner wall of the casing and having a cool air outlet in communication with the inside of the casing, the storage cart, and the compression unit. Cool air supplied by the freezing unit is delivered to the inside of the casing via the cool air outlet, such that the cool air undergoes convection inside the casing and between the storage cart and the compression unit. Therefore, the wastes are preserved at a low temperature, thus maintaining environmental hygiene.

To enable the uniform distribution of the temperature of cool air at every corner inside the casing, the freezing unit is disposed on the inner wall at the top of the casing, such that the cool air is uniformly distributed inside the casing in a top-to-bottom manner.

To enable a caretaker to understand and manage the storage, refrigeration, and compression condition of the wastes in real time, the control unit and an external computer are connected to each other for sending the signal to the computer, and the computer determines a best time for the control unit to instruct the compression unit to press the wastes.

To collect waste liquid produced from the wastes in the storage cart, the storage cart has thereunder a collector for receiving the waste liquid produced from the wastes stored in the storage cart and compressed by the compression unit. A drainpipe extending outward is disposed on the collector and adapted to draw off the waste liquid from the collector.

To guide the user in operating the waste compression device of the present invention, the control unit generates an instruction signal, whereas the interface unit receives the instruction signal and sends an operation instruction.

To enable the caretaker and the user to be informed of the level of the wastes in real time, the storage level sensor senses the level of the wastes in the storage cart and sends a level signal to the control unit, such that the interface unit receives the level signal and displays the waste level.

In a specific embodiment, the interface unit comprises a voice receiver and a speaker, or comprises a display. The interface unit further comprises at least an indicator.

In another specific embodiment, the waste compression device further comprises a battery recycling inlet formed on the casing and a battery recycling bin disposed in the casing and communicating with the battery recycling inlet. The battery recycling inlet has therein a battery quantity sensor electrically connected to the control unit for calculating a battery quantity to be displayed with the interface unit.

In yet another specific embodiment, the waste compression device further comprises a magnet disposed between the inlet and the storage cart such that ferric wastes are attracted to the magnet under an attractive magnetic force generated from the magnet, thereby allowing ferric wastes and non-ferric wastes to end up in different said storage carts.

DETAILED DESCRIPTION OF THE EMBODIMENTS OF THE INVENTION

Figure 1:
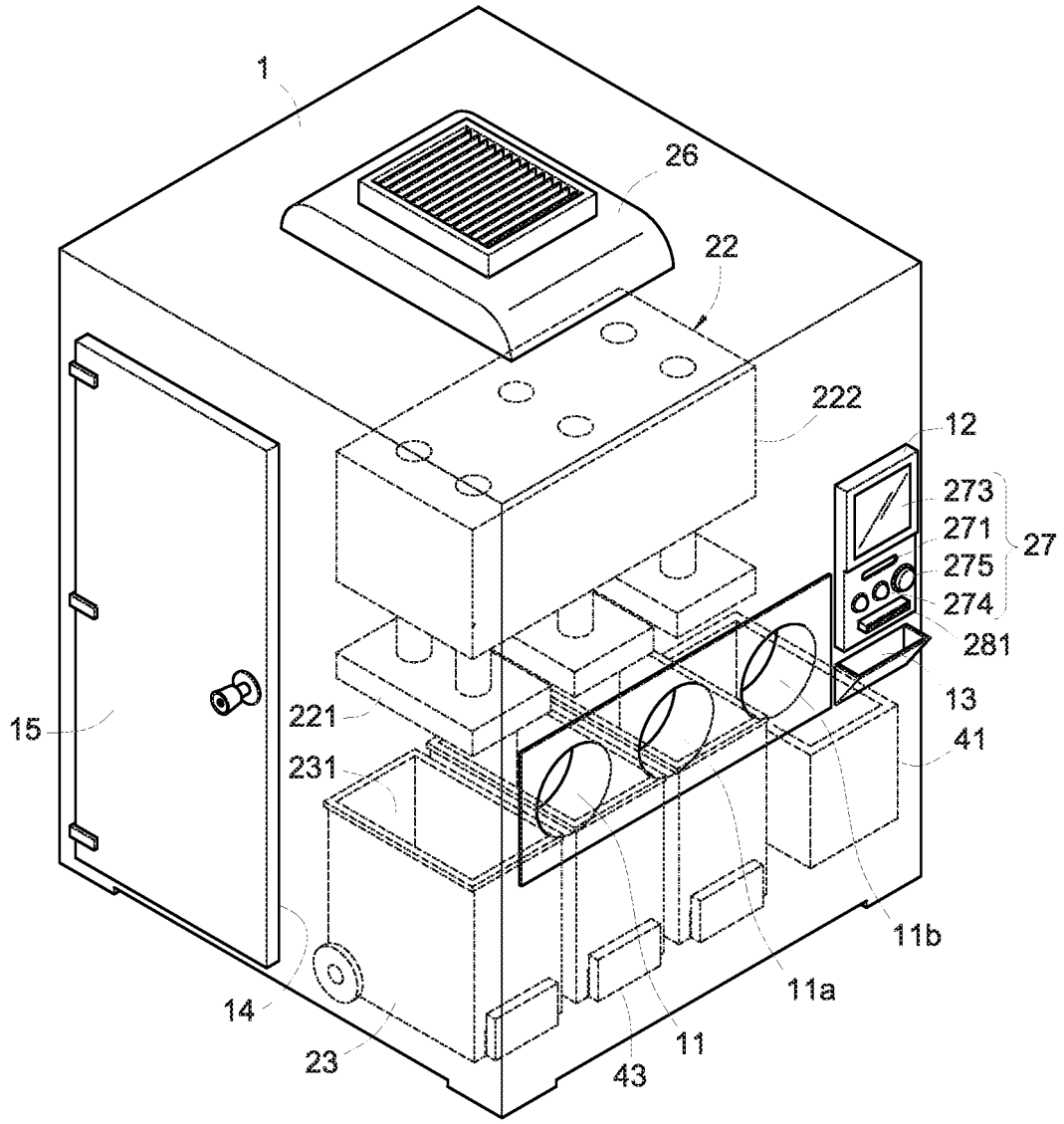
FIG. 1 is a perspective view of a preferred embodiment of the present invention.
Figure 2:
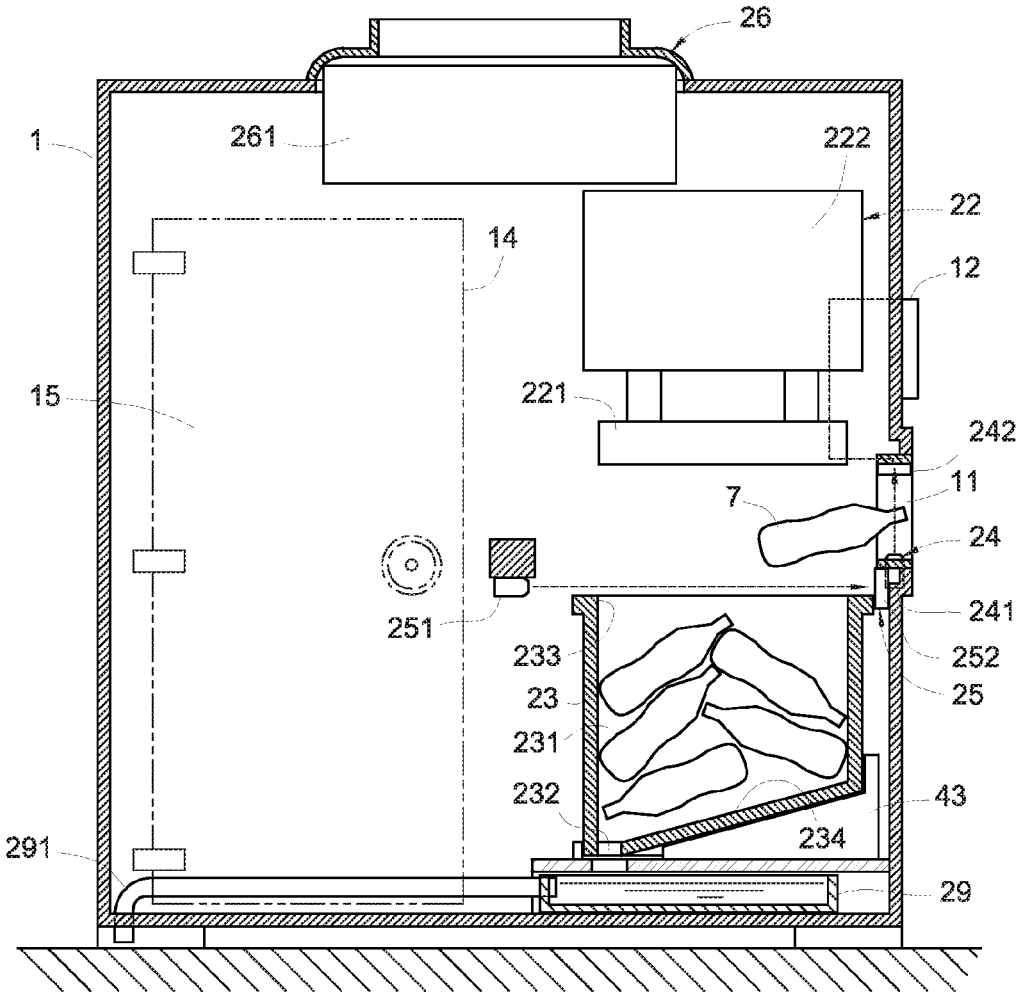
FIG. 2 is a lateral cross-sectional view of FIG. 1.
Figure 3:
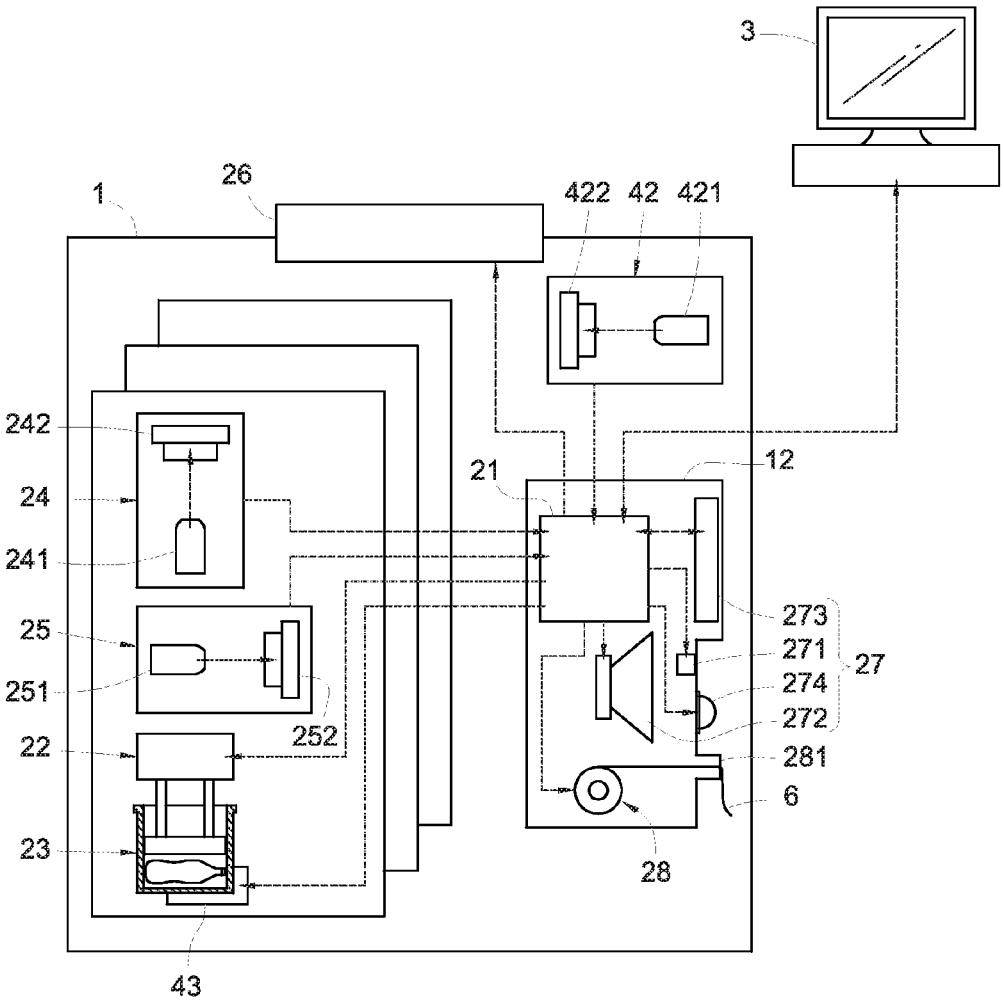
FIG. 3 is a block diagram of arrangement of elements in the embodiment of FIG. 1.

Referring to FIG. 1, there is shown a perspective view of a preferred embodiment of the present invention. Referring to FIG. 1, FIG. 2 and FIG. 3, according to the present invention, a waste compression device with a fee calculation function comprises a casing 1. A waste inlet 11 is disposed on the outer wall of the casing 1. The casing 1 has therein a control unit 21, a compression unit 22, a storage cart 23, a quantity sensor 24, a storage level sensor 25, a freezing unit 26, an interface unit 27, a ticketing unit 28, and a vibration unit 43. The control unit 21 is a control circuit board or a chip. The compression unit 22 is positioned proximate to the top of the casing 1 and electrically connected to the control unit 21. The compression unit 22 has a press plate 221 capable of vertical reciprocating movement and an actuator 222 for actuating the press plate 221.

The storage cart 23 is disposed beneath and corresponds in position to the press plate 221 of the compression unit 22. The storage cart 23 has therein a storage chamber 231 opening upward. The storage chamber 231 is disposed beneath the press plate 221 and is in communication with the inlet 11, such that a recyclable wastes 7, such as aluminum foil bags, iron cans, aluminum cans, and plastic bottles, can be cast into the casing 1 through the inlet 11 so as to be contained in the storage chamber 231 of the storage cart 23.

The vibration unit 43 is disposed at the bottom of the storage cart 23 and electrically connected to the control unit 21. The vibration unit 43 comprises therein a vibrating motor. The bottom of the storage cart 23 is in contact with the vibration unit 43 or rests on the vibration unit 43, such that the vibration unit 43 is capable of shaking the storage cart 23 to thereby shake the wastes 7 inside the storage cart 23. Therefore, the wastes 7 thus shaken sink and level off.

Figure 4:
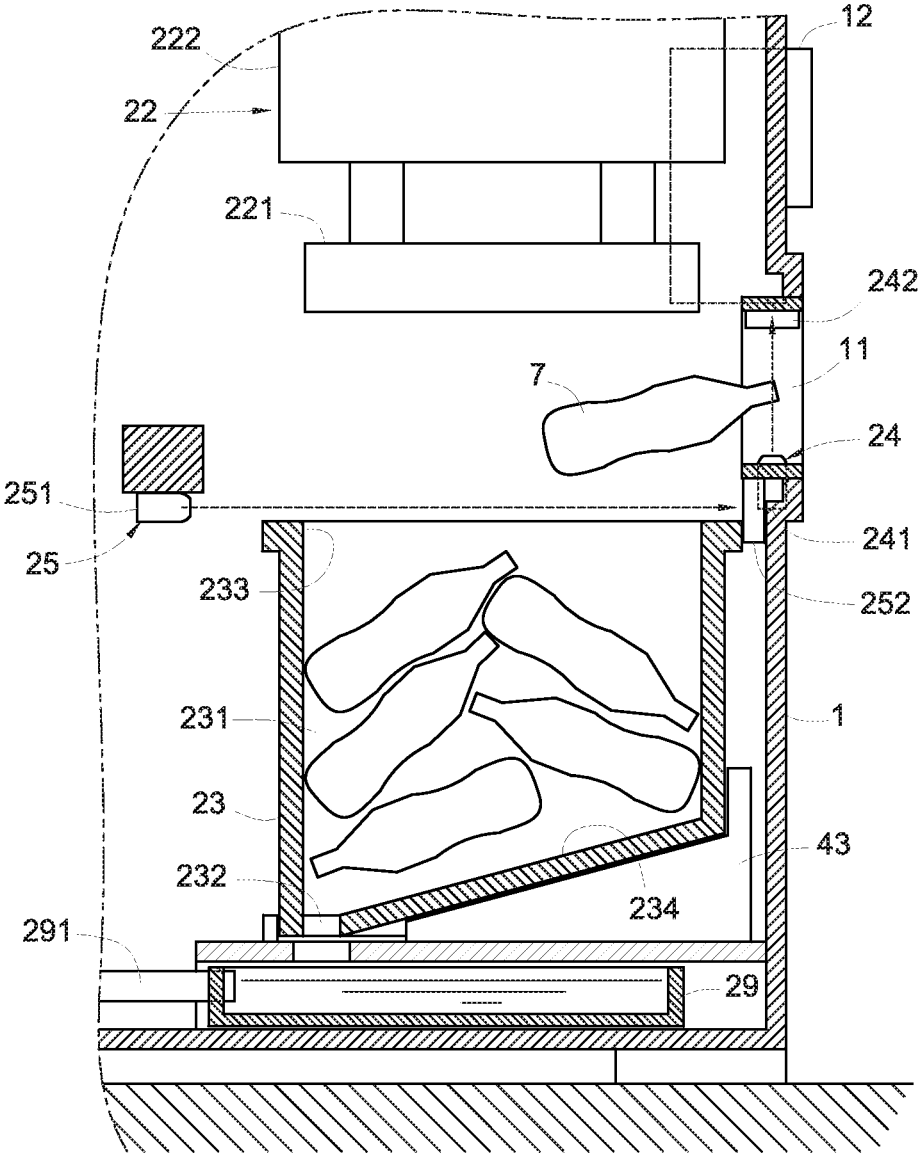
FIG. 4 is a partial enlarged cross-sectional view of FIG. 2.

The quantity sensor 24 is disposed on the inner wall of the inlet 11 and electrically connected to the control unit 21. The quantity sensor 24 comprises an emitting element 241 and a receiving element 242 which correspond in position to each other (as shown in FIG. 4). A single waste 7 passing through the inlet 11 and between the emitting element 241 and the receiving element 242 stops the receiving element 242 from receiving a signal emitted from the emitting element 241. As a result, the quantity sensor 24 senses a single blocking signal, calculates the quantity of the wastes 7, and sends a quantity signal to the control unit 21.

The storage level sensor 25 is disposed at the proximal side of a rim 233 of the storage chamber 231 of the storage cart 23 and electrically connected to the control unit 21. The storage level sensor 25 senses a level of the wastes 7 inside the storage cart 23 and determines whether the level reaches a preset height. The control unit 21 instructs the vibration unit 43 to shake the storage cart 23 as soon as the storage level sensor 25 determines that the level of the wastes 7 inside the storage cart 2 reaches the preset height for the first time, and instructs the compression unit 22 to drive the press plate 221 to press the wastes 7 inside the storage cart 23 as soon as the storage level sensor 25 detects that the level of the wastes 7 inside the storage cart 23 reaches the preset height for the second time.

In practice, the storage level sensor 25 comprises therein a counter 253 for counting the number of instances the storage level sensor 25 detects that the level of the wastes 7 reaches the preset height. The counter 253 resets to zero upon reaching the preset height for the second time, so as to restart the counting process. The preset height refers to a position below the rim 233 and within the storage chamber 231, as high as the rim 233, or above the rim 233. In this embodiment, the preset height refers to a position above the rim 233 and near the rim 233.

Figure 5:
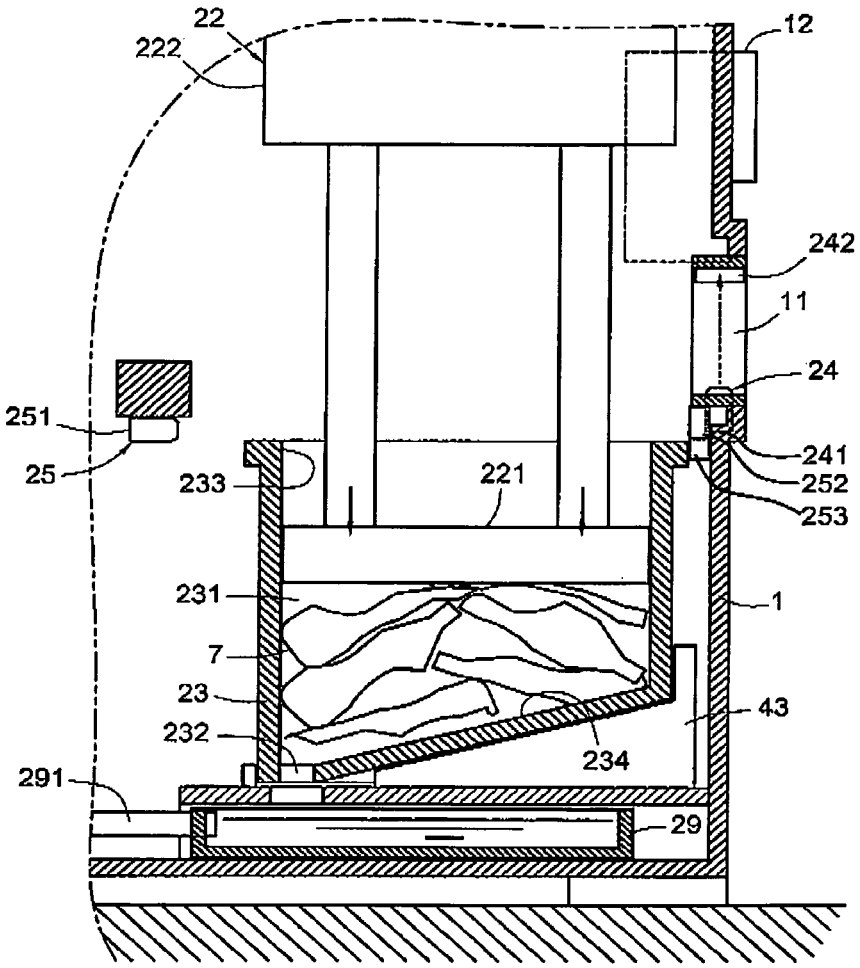
FIG. 5 is a cross-sectional view of a use state of FIG. 4.

The storage level sensor 25 comprises an emitting component 251 and a receiving component 252 which correspond in position to each other. Once the wastes 7 in the storage chamber 231 accumulate enough to rise above the rim 233, the wastes 7 located at the rim 233 of the storage chamber 231 stop the receiving component 252 from receiving a signal emitted from the emitting component 251, so as for the storage level sensor 25 to detect that the level of the wastes 7 in the storage cart 23 has reached the preset height and thereby send a level signal to the control unit 21. The level signal enables the counter of the control unit 21 to count the number of instances the level of the wastes 7 reaches the preset height, such that the control unit 21 can determine the best time to instruct the vibration unit 43 to shake the storage cart 23 and instruct the compression unit 22 to press the wastes 7 inside the storage cart 23 (see FIG. 5).

The freezing unit 26 is disposed on the inner wall at the top of the casing 1 and comprises a compressor, a condenser, and a fan. The freezing unit 26 has a cool air outlet 261 in communication with the inside of the casing 1, the storage cart 23, and the compression unit 22. Cool air supplied by the freezing unit 26 is delivered to the inside of the casing 1 via the cool air outlet 261 in a manner that the cool air spreads downward to distribute across the inside of the casing 1 uniformly, such that the cool air undergoes convection inside the casing 1 and between the storage cart 23 and the compression unit 22. Therefore, there is uniform distribution of the temperature of the cool air at every corner in the casing 1, such that the wastes 7 inside the storage cart 23 are preserved at a low temperature.

The interface unit 27 is exposed from the outer wall of the casing 1, electrically connected to the control unit 21, and adapted to receive the quantity signal and the level signal, so as to display the quantity and level of the wastes 7, such that a caretaker and a user can be informed of the quantity and level of the wastes 7 in real time.

Furthermore, the interface unit 27 is controlled by the user to send an acknowledgment signal to the control unit 21 and thereby instruct the control unit 21 to generate a ticketing signal. Alternatively, the control unit 21 can generate an instruction signal. The interface unit 27 receives the instruction signal and sends an operation instruction for guiding the user in operating appropriately.

In practice, the interface unit 27 comprises a voice receiver 271 and a speaker 272, and can also comprise a display 273 and a plurality of buttons 275. In practice, the display 273 is a liquid crystal display or a touch panel. The interface unit 27 further comprises at least an indicator 274. The speaker 272, the display 273, or the indicator 274 sends an operation instruction and displays the quantity and level of the wastes 7. The voice receiver 271, a touch panel, or the buttons 275 receives an acknowledgment signal sent from the user by means of voice-based control or manual operation.

The ticketing unit 28 is exposed from the outer wall of the casing 1 and forms a ticketing slot 281. The ticketing unit 28 is electrically connected to the control unit 21, receives the ticketing signal, and dispenses to a user a coupon 6 required for joining a points reward scheme or receiving a cash discount or a gift.

In this embodiment, a control box 12 is disposed on the outer wall of the casing 1 and adapted to house the control unit 21. The voice receiver 271, a sound aperture of the speaker 272, the display 273, the buttons 275, and the indicator 274 of the interface unit 27 as well as the ticketing slot 281 of the ticketing unit 28 are positioned on the surface of the control box 12.

Therefore, the user casts the recyclable wastes 7, which are packaged in bottles, cans, or aluminum foil bags, into the storage chamber 231 of the storage cart 23 through the inlet 11 one by one according to an operation instruction given by the interface unit 27.

At this point in time, the quantity sensor 24 detects the wastes 7 and calculates the quantity of the wastes 7, whereas the control unit 21 receives the quantity signal from the quantity sensor 24, calculates the quantity of the wastes 7 cast into the storage cart 23, and instructs the interface unit 27 to inform the user of the quantity of the wastes 7 in real time.

After casting all the available wastes 7 into the storage cart 23, the user enters an acknowledgment signal into the interface unit 27 by means of voice-based control or manual operation in accordance with an operation instruction given by the interface unit 27. Upon receipt of the acknowledgment signal, the control unit 21 stops calculating the quantity of the wastes 7 and sends the ticketing signal to the ticketing unit 28 according to the calculated quantity of the wastes 7 to thereby instruct the ticketing unit 28 to dispense the coupons 6 continuously.

Meanwhile, the freezing unit 26 delivers the cool air to the inside of the casing 1 via the cool air outlet 261 and thereby preserves the wastes 7 in the storage cart 23 at a low temperature, whereas the storage level sensor 25 keeps sensing a level of the wastes 7 in the storage cart 23 and determines whether the level has reached the preset height.

Once the storage level sensor 25 detects that the level of the wastes 7 in the storage cart 23 reaches the preset height for the first time, the control unit 21 will instruct the vibration unit 43 to shake the storage cart 23 briefly, such that the wastes 7 in the storage cart 23 sink due to the shaking. As a result, the wastes 7 in the storage chamber 231 level off, such that the level of the wastes 7 is lower than the preset height. Accordingly, the volume of the wastes 7 thus accumulated is reduced, and the storage cart 23 can store more said wastes 7.

Once the storage level sensor 25 detects that the level of the wastes 7 in the storage cart 23 reaches the preset height for the second time, the control unit 21 will instruct the actuator 222 of the compression unit 22 to drive the press plate 221 to move downward into the storage chamber 231 and thereby cause the press plate 221 to perform top-to-bottom compression of the wastes 7 in the storage chamber 231, such that the level of the wastes 7 is lower than the preset height. Therefore, after being compressed by the press plate 221 of the compression unit 22, the wastes 7 in the storage chamber 231 continue to be stored inside the storage cart 23.

Therefore, the recyclable wastes 7 packaged in bottles, cans, or aluminum foil bags are cast into the storage cart 23 through the inlet 11. Once the storage level sensor 25 detects that the level of the wastes 7 in the storage cart 23 reaches the preset height, the storage level sensor 25 will instruct the compression unit 22 to drive the press plate 221 to perform top-to-bottom compression of the wastes 7 in the storage cart 23 to thereby reduce the volume of the wastes 7, especially the volume of the bulky recyclable wastes 7, such as PET bottles or cartons, thus increasing the storage capacity of the storage cart 23 and deceasing the required number of instances the wastes 7 are collected.

The freezing unit 26 delivers the cool air to every corner of the inside of the casing 1. Therefore, there is uniform distribution of the temperature of the cool air inside the casing 1. Therefore, water-containing wastes or leftovers, which are stored in the storage cart 23, can be preserved at a low temperature, so as to prevent the wastes or leftovers from producing a foul odor, breeding vector mosquitoes, and causing environmental pollution.

By shaking the storage cart 23 with the vibration unit 43, it is feasible to enable the wastes 7 in the storage chamber 231 to level off and thereby enhance the efficiency of the storage of the wastes 7 therein with a view to reducing the volume of wastes and maintaining environmental hygiene.

In a variant embodiment, multiple said inlets 11, multiple said compression units 22, multiple said storage carts 23, multiple said quantity sensors 24, multiple said storage level sensors 25, and multiple said vibration units 43 are provided and disposed inside single said casing 1. Therefore, the user can cast aluminum foil bags, iron cans, aluminum cans, and plastic bottles into the different inlets 11, 11*a*, 11*b*, respectively, for processing, according to an operation instruction given by the interface unit 27.

A gate 14 is disposed on one side of the casing 1 and adapted to remove the wastes 7 from the storage cart 23. The gate 14 is shut with a door panel 15. Once the storage cart 23 is full, a janitor will take the storage cart 23 out via the gate 14 and collect the compressed wastes 7 in the storage cart 23.

The control unit 21 and an external computer 3 are connected to each other by wired connection or wireless connection for sending the quantity signal, the level signal, the acknowledgment signal, and the ticketing signal to the computer 3. The computer 3 determines the best time for the control unit 21 to instruct the compression unit 22 to press the wastes 7, such that the caretaker can understand and manage the storage, refrigeration, and compression condition of the wastes 7 and thereby perform remote management.

To collect the waste liquid produced from the wastes 7 inside the storage cart 23, at least a leakage hole 232 is formed at the bottom of the storage cart 23. A collector 29 is disposed beneath the leakage hole 232 of the storage cart 23 to receive, via the leakage hole 232, the waste liquid produced from the wastes 7 stored in the storage cart 23 and compressed by the compression unit 22. A drainpipe 291 extending to the outside is disposed at one end of the collector 29 and adapted to draw off the waste liquid from the collector 29.

A slope 234 that faces upward is formed at the bottom of the storage chamber 231 for guiding the waste-derived waste liquid in flowing toward the bottom of the storage chamber 231 and thereby flowing into the leakage hole 232.

A battery recycling inlet 13 is formed on the outer wall of the casing 1. A battery recycling bin 41 in communication with the battery recycling inlet 13 is disposed inside the casing 1. A battery quantity sensor 42 is disposed inside the battery recycling inlet 13 and electrically connected to the control unit 21. The battery quantity sensor 42 comprises an emitting element 421 and a receiving element 422 which correspond in position to each other. A single battery passing through the battery recycling inlet 13 and between the emitting element 421 and the receiving element 422 stops the receiving element 422 from receiving a signal sent from the emitting element 421, thereby allowing the battery quantity sensor 42 to sense a single blocking signal, calculate a battery quantity, and display the battery quantity with the interface unit 27.

Figure 6:
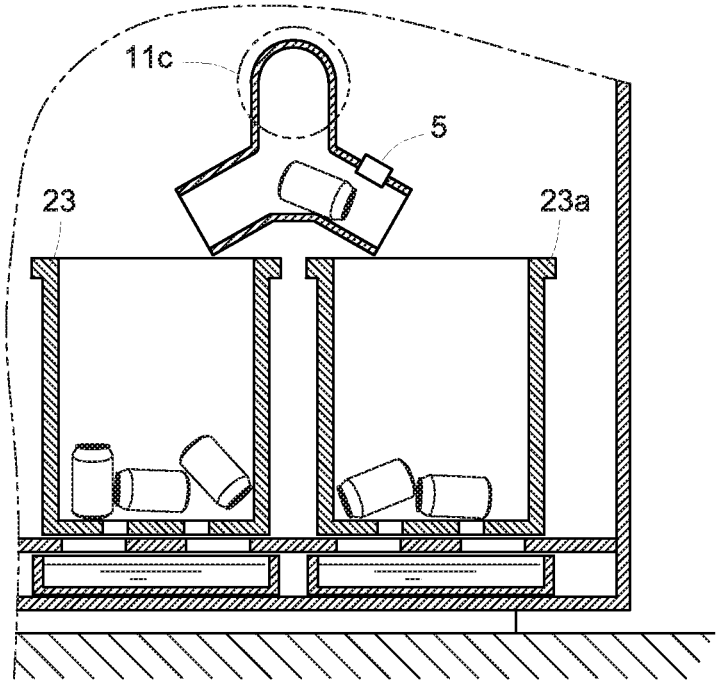
FIG. 6 is a cross-sectional view of an additional embodiment related to the embodiment of FIG. 1.

It is also feasible to provide an inlet 11*c* for wastes, such as iron cans and aluminum cans, in the form of a single inlet (as shown in FIG. 6), and position a magnet 5 between the inlet 11*c* and a storage cart 23*a* intended for iron cans. Under an attractive magnetic force generated from the magnet 5, ferric wastes, such as iron cans, fall into the storage cart 23*a*. As a result, non-ferric wastes and ferric wastes end up in different said storage carts 23, 23*a*, respectively.

Compared with the prior art, the present invention discloses sensing the level of the wastes 7 with the storage level sensor 25 continuously, determining automatically to instruct the vibration unit 43 to shake the storage cart 23, determining the best time to actuate the compression unit 22 to compress the wastes 7, counting the wastes 7 automatically with the quantity sensor 24, displaying the quantity of the wastes 7 with the interface unit 27, allowing the user to know the precise quantity of the wastes 7 cast into the storage cart 23, enabling the ticketing unit 28 to dispense the coupon 6 required for joining a points reward scheme or receiving a cash discount or a gift so as to encourage consumers to take the initiative in recycling the wastes 7, keeping the wastes 7 at a low temperature with the freezing unit 26, and therefore enhancing the ease of compressing and freezing the wastes 7 and calculating the quantity of the wastes 7.

What is claimed is:

1. A waste compression device with a fee calculation function, comprising a casing, the casing having a waste inlet disposed on an outer wall of the casing, and having therein:

a control unit;

a compression unit positioned proximate to a top of the casing and electrically connected to the control unit;

a storage cart disposed beneath and corresponding in position to the compression unit, the storage cart being in communication with the inlet, such that wastes fall into the storage cart;

a vibration unit disposed at a bottom of the storage cart, electrically connected to the control unit, and shakes the storage cart, such that the wastes in the storage cart level off;

a quantity sensor, disposed in the inlet and electrically connected to the control unit, comprising an emitting element and a receiving element receiving a signal emitted from the receiving element where the emitting element and the receiving element correspond in position to each other, and the quantity sensor being capable of calculating a quantity of the wastes in such a way that when the signal is blocked by one of the wastes passing through the waste inlet between the emitting element and the receiving element, the quantity sensor senses the one of the wastes, thereby calculating the quantity of the wastes and sending a quantity signal to the control unit;

a storage level sensor, disposed at a proximal side of the storage cart and electrically connected to the control unit, and comprising an emitting component, a receiving component receiving a signal emitted from the emitting component where the emitting component and the receiving component correspond in position to each other, and a counter for counting a number of times a level of the wastes reaching a preset height, the storage level sensor capable of determining whether the level of the wastes in the storage cart reaches the preset height, such that once the wastes in the storage cart accumulate enough to rise above at the preset height and block the signal from the emitting component, the storage level sensor sends a level signal to the control unit, and wherein the control unit is configured to trigger the vibration unit to shake the storage cart according to the level signal in order to level off the wastes in the storage cart when the counter of the storage level sensor indicates one, and the control unit is configured to trigger the compression unit to press the wastes in the storage cart when the counter of the storage level sensor indicates two;

an interface unit exposed from the casing, electrically connected to the control unit, receiving the quantity signal and display the quantity of the wastes, and sending an acknowledgment signal to the control unit, so as to cause the control unit to generate a ticketing signal; and a ticketing unit exposed from the casing, electrically connected to the control unit, and receiving the ticketing signal and dispense a coupon.

2. The waste compression device with a fee calculation function of claim 1, further comprising a freezing unit disposed on an inner wall at a top of the casing and having a cool air outlet in communication with an inside of the casing, the storage cart, and the compression unit, the freezing unit supplying cool air to the inside of the casing via the cool air outlet for convection in the inside of the casing and between the storage cart and the compression unit, such that the wastes are preserved at a low temperature.

3. The waste compression device with a fee calculation function of claim 1, wherein a collector is disposed beneath the storage cart for receiving waste liquid produced from the wastes in the storage cart, and a drainpipe extending outward is disposed on the collector.

4. The waste compression device with a fee calculation function of claim 1, wherein the interface unit further receives the level signal and displays the level of the wastes.

5. The waste compression device with a fee calculation function of claim 1, wherein the interface unit comprises a voice receiver and a speaker.

6. The waste compression device with a fee calculation function of claim 1, further comprising a battery recycling inlet formed on the casing and a battery recycling bin disposed in the casing and communicating with the battery recycling inlet, the battery recycling inlet having therein a battery quantity sensor electrically connected to the control unit for calculating a battery quantity to be displayed with the interface unit.

7. The waste compression device with a fee calculation function of claim 1, further comprising a magnet disposed between the inlet and the storage cart such that ferric wastes are attracted to the magnet under an attractive magnetic force generated from the magnet, thereby allowing ferric wastes and non-ferric wastes to end up in different said storage carts.

8. The waste compression device with a fee calculation function of claim 1, wherein the counter resets the number of the volume of the wastes reaching the preset height to zero upon reaching the preset height for the second time, so as to restart the counting process.

* * * * *